US010305233B2

(12) United States Patent
Chen

(10) Patent No.: US 10,305,233 B2
(45) **Date of Patent: *May 28, 2019**

(54) LAMP

(71) Applicant: Ching-Hui Chen, Huizhou (CN)

(72) Inventor: Ching-Hui Chen, Huizhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/810,339

(22) Filed: Nov. 13, 2017

(65) Prior Publication Data

US 2018/0138645 A1 May 17, 2018

(30) Foreign Application Priority Data

Nov. 14, 2016 (CN) ..... 2016 2 1224578 U

(51) Int. Cl.

| | |
|---|---|
| ***H01R 13/74*** | (2006.01) |
| ***F21V 1/00*** | (2006.01) |
| ***F21V 21/10*** | (2006.01) |
| ***H01R 24/62*** | (2011.01) |
| ***H01R 33/22*** | (2006.01) |
| ***H01R 33/92*** | (2006.01) |
| ***F21S 6/00*** | (2006.01) |
| *H01R 107/00* | (2006.01) |
| *H01R 31/06* | (2006.01) |

(52) U.S. Cl.

CPC ..... *H01R 13/743* (2013.01); *F21S 6/00* (2013.01); *F21V 1/00* (2013.01); *F21V 21/10* (2013.01); *H01R 24/62* (2013.01); *H01R 33/225* (2013.01); *H01R 33/92* (2013.01); *H01R 31/065* (2013.01); *H01R 2107/00* (2013.01)

(58) Field of Classification Search

CPC .... H01R 13/743; H01R 33/92; H01R 33/225; H01R 24/62; H01R 2107/00; F21V 21/10; F21V 1/00

See application file for complete search history.

(56) References Cited

U.S. PATENT DOCUMENTS

| | | | | |
|---|---|---|---|---|
| 8,545,039 | B2 * | 10/2013 | Patel | F21S 6/002 307/43 |
| 9,109,791 | B2 * | 8/2015 | Lin | F21V 33/0052 |
| 9,472,955 | B2 * | 10/2016 | Jones | H02J 4/00 |
| 9,784,417 | B1 * | 10/2017 | Springer | F21K 9/238 |
| 2012/0070153 | A1 * | 3/2012 | Jonsson | H04L 12/2827 398/115 |
| 2015/0259078 | A1 * | 9/2015 | Filipovic | H04W 88/08 244/114 R |

(Continued)

*Primary Examiner* — Kevin Quarterman
(74) *Attorney, Agent, or Firm* — Rosenberg, Klein & Lee

(57) ABSTRACT

The present invention discloses a lamp, which comprises a lamp seat installed in a base. The lamp seat is electrically connected with a circuit board. At least one USB interface includes a cartridge disposed in the base and a USB socket module disposed inside the cartridge. A wall of the cartridge, which is corresponding to the socket of the USB socket module, has at least one opening. The interface of an external USB data line can be passed through the opening and inserted into the socket of the USB socket module. The USB socket module is separated from the circuit board and electrically connected with the circuit board through cables. Therefore, the USB interface is reduced to a smaller size and requires less space for installation. Thus, the position for installing the USB interface has higher selectivity, and the overall esthetics of the base is improved.

8 Claims, 4 Drawing Sheets

(56) References Cited

U.S. PATENT DOCUMENTS

| | | | | |
|---|---|---|---|---|
| 2016/0153650 | A1* | 6/2016 | Chien | F21V 33/0004<br>362/253 |
| 2017/0159929 | A1* | 6/2017 | Li | F21V 33/0024 |
| 2018/0013229 | A1* | 1/2018 | Goulden | H01R 13/5219 |
| 2018/0115123 | A1* | 4/2018 | Wright | H01R 13/73 |

* cited by examiner

LAMP

This application claims priority for China patent application no. 201621224578.6 filed on Nov. 14, 2016, the content of which is incorporated by reference in its entirety.

BACKGROUND OF THE INVENTION

Field of the Invention

The present invention relates to an illumination technology, particularly to a lamp.

Description of the Related Art

Some current standard lamps are equipped with USB connectors, which can be connected with an external USB power cord to recharge electronic products, such as mobile phones, tablet computers, electronic books, etc.

The existing standard lamp comprises mainly a standard, a lamp seat installed in the standard, a lamp, a circuit board, and a USB connector. The interfaces of the USB connectors are soldered onto the circuit board and electrically connected with the circuit board, cooperating with the circuit board to form an integral structure. However, such a structure containing the USB connectors and the circuit board occupies a larger volume and may hinder the installation of the USB connectors. For example, it is inconvenient to install the UBS connectors in the standard of the standard lamp, especially a smaller standard. Further, the bulky USB connectors are likely to degrade the overall esthetics of the standard.

SUMMARY OF THE INVENTION

The primary objective of the present invention is to provide a lamp to improve the convenience of installing the USB interfaces and the overall esthetics of the base.

In order to achieve the abovementioned objective, the present invention proposes a lamp, which comprises a base, a lamp seat installed in the base, a circuit board, and at least one USB interface. The lamp seat is electrically connected with the circuit board. The USB interface includes a cartridge disposed in the base and a USB socket module disposed inside the cartridge. The USB socket module is separated from the circuit board and electrically connected with the circuit board through cables. The USB socket module includes at least one of Type-C USB sockets, Micro USB sockets, and Mini USB sockets. A wall of the cartridge, which is corresponding to the socket of the USB socket module, has at least one opening. The interface of an external USB data line can be passed through the opening and inserted into the socket of the USB socket module.

The present invention respectively disposes the USB socket module and the circuit board at different positions, whereby to reduce the size of the USB interface and decrease the space volume required for installing the USB interface. Therefore, the present invention can increase the flexibility of installing the USB interface (e.g. installing the USB interface in a smaller base) and improve the overall esthetics of the base.

DETAILED DESCRIPTION OF THE INVENTION

Below, embodiments and attached drawings are described in detail to clearly and completely demonstrate the technical contents of the present invention. It should be noted: these embodiments are not all the embodiments but only a part of the embodiments of the present invention; the embodiments made by the persons having ordinary knowledge in the field according to the technical contents of the present invention without creative labor would be included by the scope of the present invention.

It should be noted also: the positional or directional adjective used in the specification, such as upper, lower, left, right, front, rear, top, bottom, inner, outer, vertical, horizontal, transverse, longitudinal, clockwise, counterclockwise, circumferential, radial, axial, etc., is only to describe the relative position of the components in a special viewing angle. If the viewing angle is changed, the positional or directional description should be changed also.

It should be noted further: the ordinal adjective, such as first, second, etc., used in the specification is not necessarily to imply the importance of the described item or the quantity of the total items in the same group but normally to distinguish one from the others among the same group. While "first" or "second" is used to describe an item, it indicates or implies that at least one mentioned item exits in the embodiment. Two embodiments can be integrated if the persons having ordinary knowledge in the field can realize the integration of the technical schemes thereof. If the technical schemes of two embodiments are contradictory and the integration thereof is unlikely to realize, the integration of the two embodiments is regarded as impossible and not included by the scope of the present invention.

The present invention proposes a standard lamp.

Figure 1:
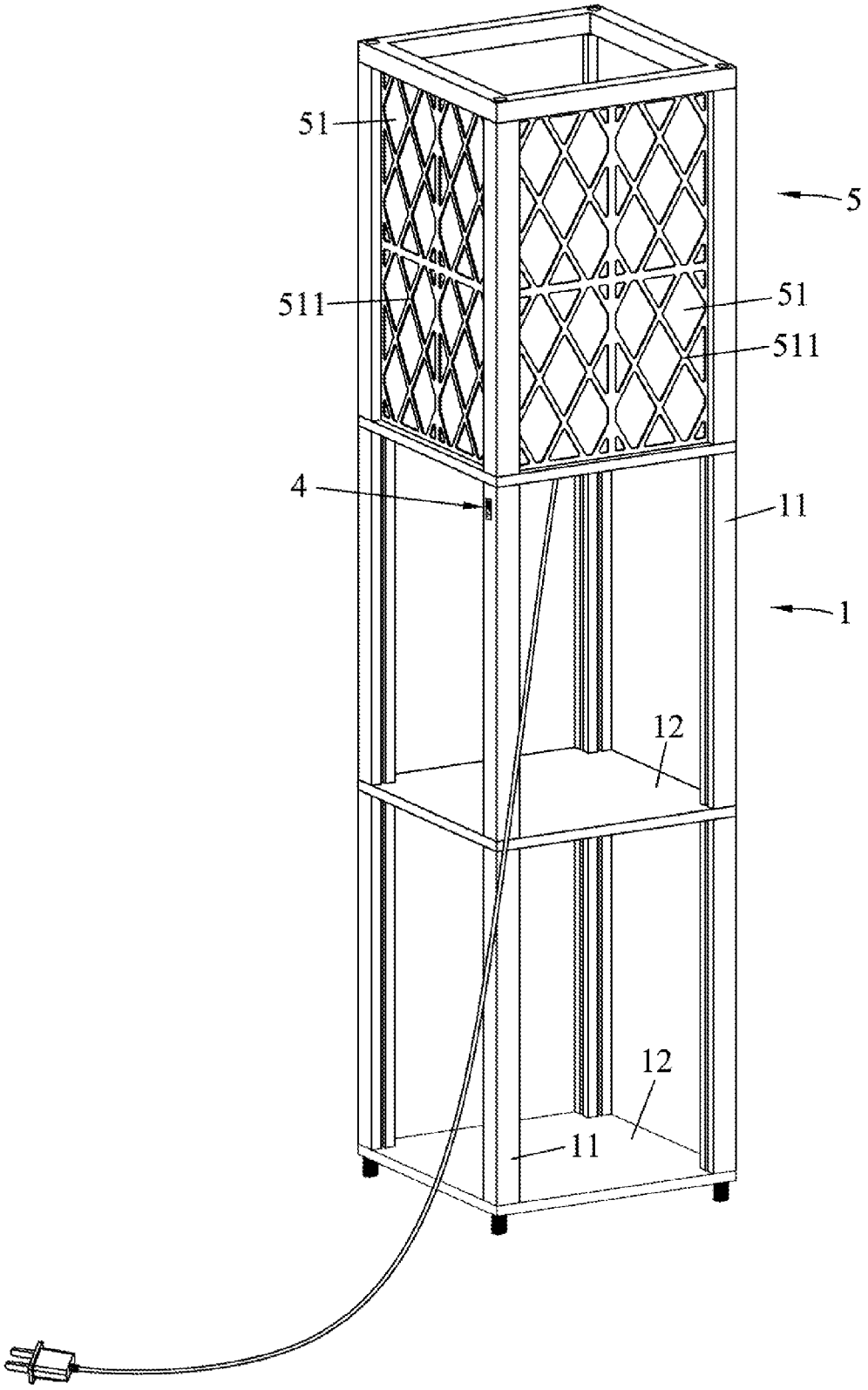
FIG. 1 is a perspective view schematically showing a lamp according to one embodiment of the present invention.
Figure 2:
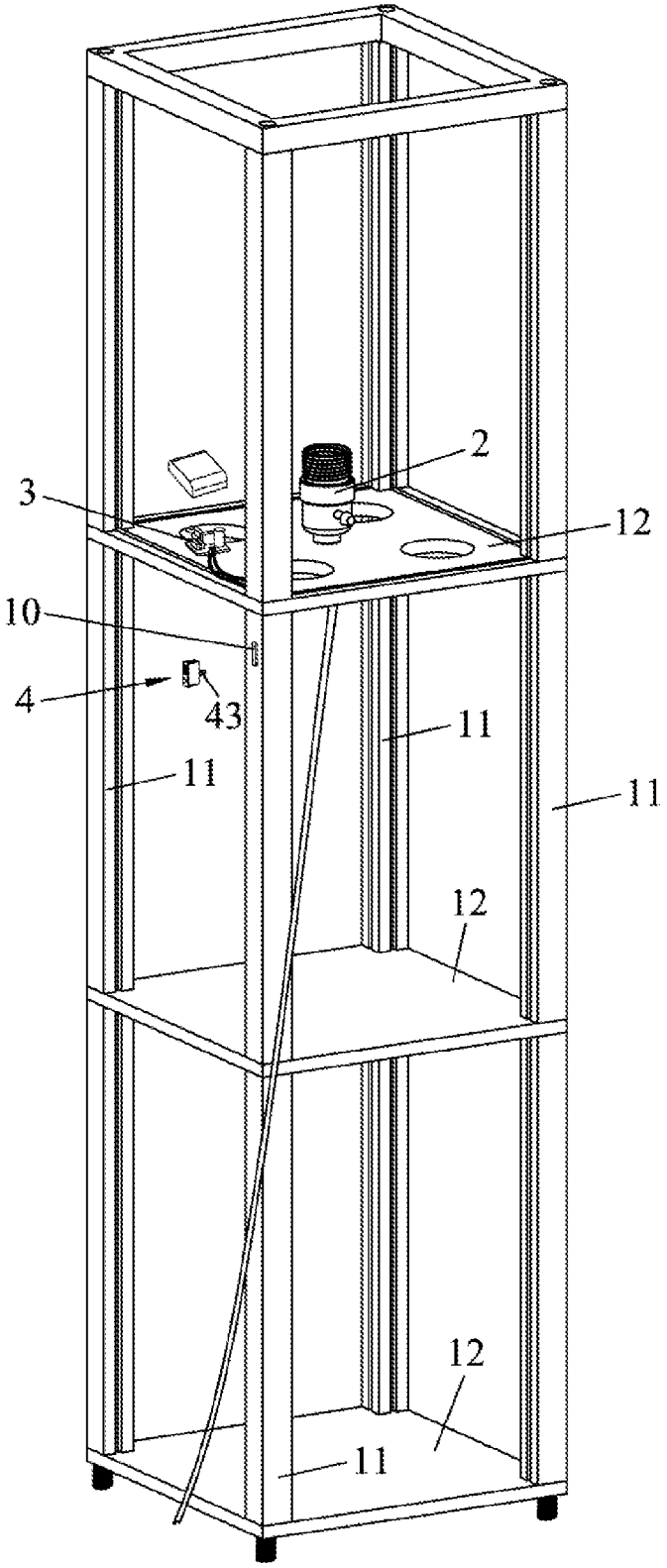
FIG. 2 is a perspective view schematically showing a lamp whose lamp shade is removed according to one embodiment of the present invention.
Figure 3:
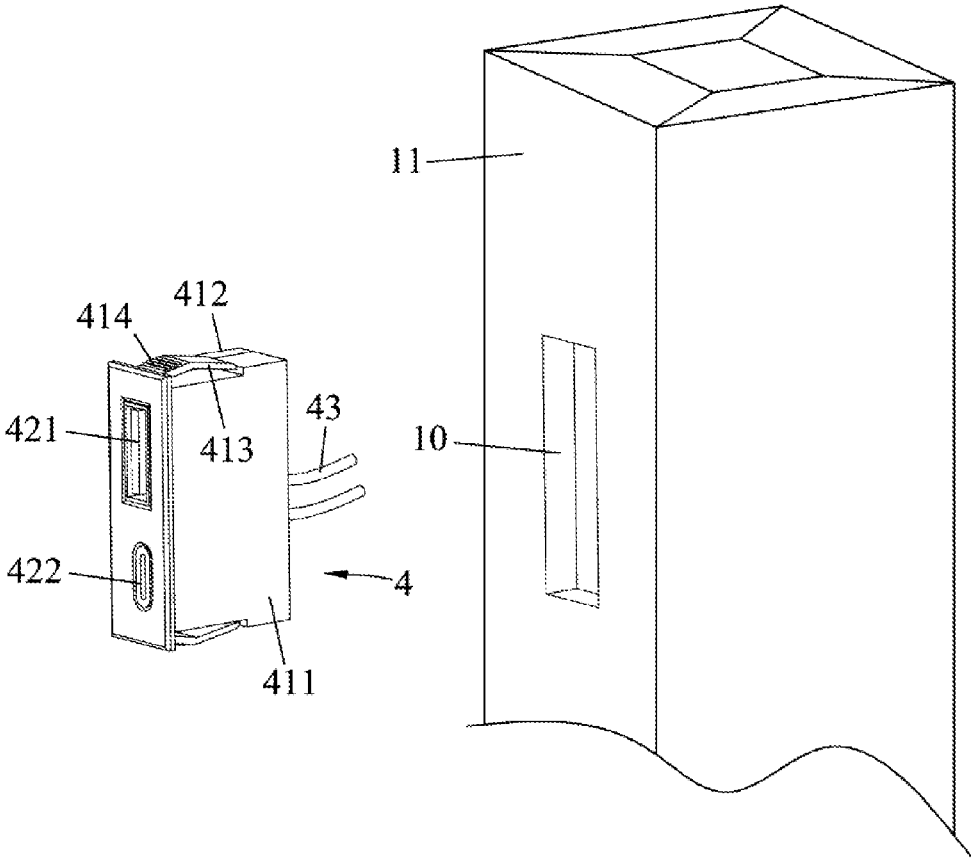
FIG. 3 is an exploded view schematically showing a stud and a USB interface of a lamp according to one embodiment of the present invention.
Figure 4:
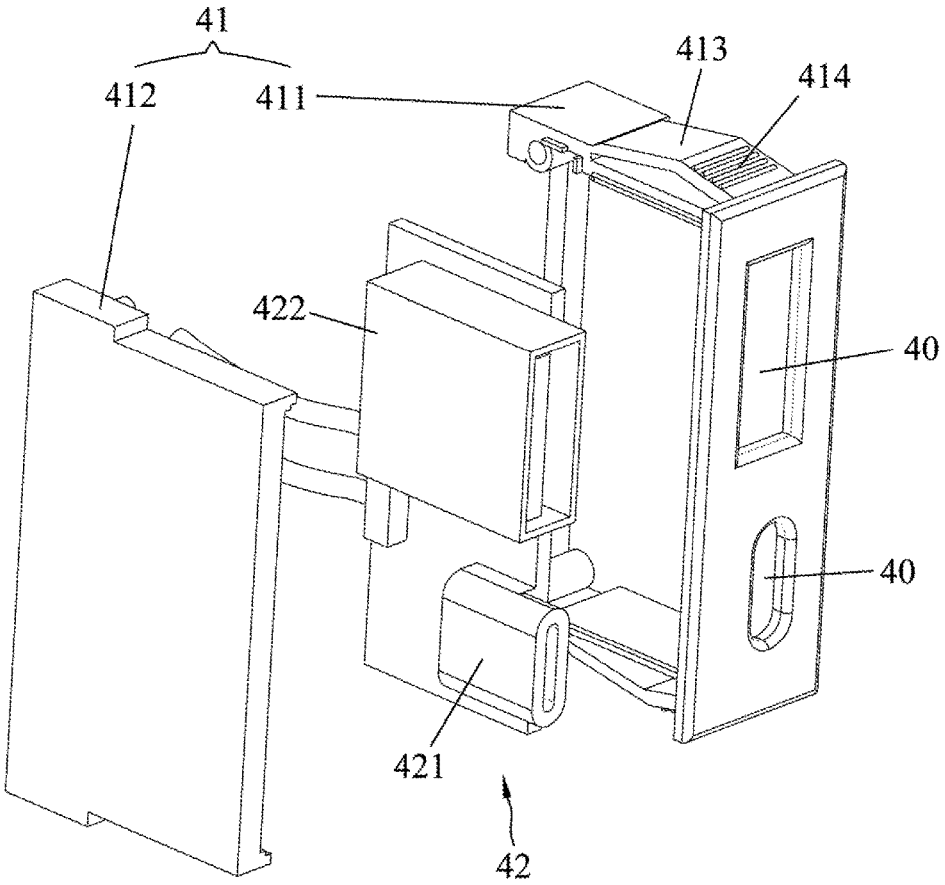
FIG. 4 is an exploded view schematically showing a USB interface of a lamp according to one embodiment of the present invention.

Refer to FIGS. 1-4. In one embodiment, the lamp of the present invention comprises a base 1, a lamp seat 2 installed in the base 1, a circuit board 3, and at least one USB interface 4. The lamp seat 2 is electrically connected with the circuit board 3, and a lamp is installed in the lamp seat 2. The circuit board 3 is electrically connected with a power source (not shown in the drawings) through a power cord. The power source may be commercial power or batteries. The USB interface 4 includes a cartridge 41 installed in the base 1 and a USB socket module 42 installed inside the cartridge 41. The USB socket module 42 is separated from the circuit board 3 and electrically connected with the circuit board 3 through cables 43. Thereby, the USB interface 4 is reduced to a smaller size and requires less space for installation. Therefore, the position of installing the USB interface 4 has higher selectivity. For example, the USB interface 4 can be installed in a smaller base 1. Further, the overall esthetics of the base 1 is improved. The USB socket module 42 includes at least one of Type-C USB sockets 421, Micro USB sockets 422, and Mini USB sockets (not shown in the drawings). As shown in FIG. 4, the USB socket module 42 includes a Type-C USB socket 421 and a Micro USB socket 422. A wall of the cartridge 41, which is corresponding to the socket of the USB socket module 42, has at least one opening 40. The interface of an external USB data line, such as a Type-C USB data line, a Micro USB data line, or a Mini USB data line, can be passed through the opening 40 and inserted into the socket of the USB socket module 42.

As shown in FIG. 2, the base 1 includes a plurality of studs 11 distributed in a polygonal way and a plurality of support boards 12 connected with all the studs 11. The support boards 12 are used to support structure, install components and receive objects. The lamp seat 2 and the circuit board 3 are installed on the support board 12 disposed in the upper region of the base 1. In one embodiment, the lamp has four studs 11 disposed in a rectangular way. In other embodiments, the lamp has three, five, or more studs 11. While the lamp has three studs 11, they are disposed in triangular way.

In the present invention, at least one stud 11 has an installation hole 10 for installing the cartridge 41. In installing the cartridge 41, the opening 40 is faced outward, whereby the interface of the external USB data line can be inserted into the socket of the USB socket module 42.

Refer to FIG. 3 and FIG. 4. In one embodiment, the cartridge 41 is made of plastic and includes a casing 411 whose one side is open and a cover 412 connected with the casing 411 and covering the casing 411. The casing 411 and the cover 412 are detachably connected with each other. For example, the casing 411 and the cover 412 are detachably connected with each other via screws or press-fit mechanisms. Besides, the casing 411 and the cover 412 can be detachably connected with each other via pins and pin holes.

Refer to FIG. 3 and FIG. 4. In one embodiment, the cartridge 41 has avoidance recesses on at least one set of opposite sides. An elastic plate 413 is arched upward and connected with the front wall and the rear wall of the avoidance recess. While pressed, the elastic plate 413 is elastically deformed toward the avoidance recess. One surface of the elastic plate 413, which faces outward, has press-fit teeth 414 protruding outward. After the cartridge 41 is press-fitted into the installation hole 10, the press-fit teeth 414 press against the corresponding wall of the installation hole 10, whereby the cartridge 41 is tightly secured inside the installation hole 10.

In one embodiment, a lamp shade 5 is disposed around a region of the base 1, which is corresponding to the lamp seat 2. The lamp shade 5 encloses the lamp seat 2 thereinside. In one embodiment, the lamp shade 5 includes a plurality of enclosing boards 51 each connected with the neighboring studs 11. The plurality of enclosing boards 51 forms a space with the lamp seat 2 thereinside.

In one embodiment, ribs 511 are formed on the external surface of the enclosing board 51 for decorating the lamp and enhancing the structure.

The embodiments described above are only to exemplify the present invention but not to limit the scope of the present invention. The equivalent modification or variation according to the technical contents disclosed in the specification is to be also included by the scope of the present invention.

What is claimed is:

1. A lamp comprising a base, a circuit board, a lamp seat installed in said base and electrically connected with said circuit board, and at least one USB interface, wherein said USB interface includes a cartridge disposed in said base and a USB socket module disposed inside said cartridge, and wherein said USB socket module is separated from said circuit board and electrically connected with said circuit board through cables, and wherein said USB socket module includes at least one of Type-C USB sockets, Micro USB sockets, and Mini USB sockets, and wherein a wall of said cartridge, which is corresponding to a socket of said USB socket module, has at least one opening, and wherein an interface of an external USB data line can be passed through said opening and inserted into said socket of said USB socket module, said base includes a plurality of studs distributed in a polygonal way and a plurality of support boards connected with all said studs, and wherein said lamp seat and said circuit board are installed on said support board disposed in an upper region of said base, and wherein at least one said stud has an installation hole for installing said cartridge, and wherein after said cartridge is installed in said installation hole, said opening is faced outward.

2. The lamp according to claim 1, wherein there are four said studs disposed in a rectangular way.

3. The lamp according to claim 1, wherein said cartridge has avoidance recesses on at least one set of opposite sides; an elastic plate is arched upward and connected with a front wall and a rear wall of said avoidance recess; while pressed, said elastic plate is elastically deformed toward said avoidance recess; one surface of said elastic plate, which faces outward, has press-fit teeth protruding outward; after said cartridge is press-fitted into said installation hole, said press-fit teeth press against a wall of said installation hole, which faces said press-fit teeth.

4. The lamp according to claim 1, wherein a lamp shade is disposed around a region of said base, which is corresponding to said lamp seat, and wherein said lamp shade encloses said lamp seat thereinside.

5. The lamp according to claim 4, wherein said lamp shade includes a plurality of enclosing boards each connected with neighboring ones of said studs, and wherein said enclosing boards form a space with said lamp seat thereinside.

6. The lamp according to claim 5, wherein ribs are formed on an external surface of said enclosing board.

7. A lamp comprising a base, a circuit board, a lamp seat installed in said base and electrically connected with said circuit board, and at least one USB interface, wherein said USB interface includes a cartridge disposed in said base and a USB socket module disposed inside said cartridge, and wherein said USB socket module is separated from said circuit board and electrically connected with said circuit board through cables, and wherein said USB socket module includes at least one of Type-C USB sockets, Micro USB sockets, and Mini USB sockets, and wherein a wall of said cartridge, which is corresponding to a socket of said USB socket module, has at least one opening, and wherein an interface of an external USB data line can be passed through said opening and inserted into said socket of said USB socket module, said base includes a plurality of studs distributed in a polygonal way and a plurality of support boards connected with all said studs, and wherein said lamp seat and said circuit board are installed on said support board disposed in an upper region of said base, and wherein said cartridge is made of plastic and includes a casing whose one side is open and a cover connected with said casing and covering said casing.

8. The lamp according to claim 7, wherein said casing and said cover can be detachably connected with each other through screw structures or press-fit structures.

* * * * *